United States Patent [19]

Olsen

[11] Patent Number: 4,671,843

[45] Date of Patent: Jun. 9, 1987

[54] LABEL TRANSPORT VACUUM DRUM

[75] Inventor: Robert F. Olsen, Toledo, Ohio

[73] Assignee: Owens-Illinois, Inc., Toledo, Ohio

[21] Appl. No.: 856,310

[22] Filed: Apr. 28, 1986

[51] Int. Cl.[4] ..... B65C 9/04; B65C 9/22

[52] U.S. Cl. ..... 156/450; 156/458; 156/497; 156/568; 156/578; 156/DIG. 13; 156/DIG. 26; 156/DIG. 35

[58] Field of Search ..... 156/446, 450, 455, 458, 156/497, 521, 568, 578, DIG. 26, DIG. 33, DIG. 35, DIG. 13

[56] References Cited

U.S. PATENT DOCUMENTS

| | | | |
|---|---|---|---|
| 4,108,710 | 8/1978 | Hoffmann | 156/450 |
| 4,526,645 | 7/1985 | Malthouse et al. | 156/568 |
| 4,574,020 | 3/1986 | Fosnaught | 156/450 |
| 4,592,796 | 6/1986 | Schlacht | 156/458 |

*Primary Examiner*—Michael Wityshyn
*Attorney, Agent, or Firm*—John R. Nelson

[57] ABSTRACT

A cylindrical vacuum drum for carrying a label held to its surface by vacuum past an adhesive applying roll to a position where the label will touch a container and the container will be rolled along the drum surface to thereby apply the label about the container. The drum is formed of metal and is mounted for rotation about its vertical axis. The drum has a rubberlike covering thereover with at least two raised areas in the cover, which underlie the leading and trailing edge of a label that is at a greater radius than the rest of the surface. These are the areas which serve to press the label against the adhesive roll or solvent applying gravure roll. These areas have very slightly depressed zones forming slight steps just in advance thereof with a row of vacuum ports extending through the cover at the base of said steps to effectively hold the leading edge of the label down and allow the trailing edge to bend upwardly away from the outer surface of the drum. Additionally, replaceable insert strips are provided for the trailing edge of each raised pad that underlies the trailing edge of the labels so that this area which exhibits the most wear can be replaced rather than require replacing the entire drum.

5 Claims, 6 Drawing Figures

LABEL TRANSPORT VACUUM DRUM

BACKGROUND OF THE INVENTION

It has been the practice, as set forth in U.S. Pat. No. 4,574,020, issued March 4, 1986, to receive plastic labels on the surface of a cylindrical vacuum drum and to carry the individual label into tangential contact with a gravure roll. The gravure roll is formed with finite areas which receive a solvent for the plastic from a fountain and the finite areas will apply the solvent to the foam side of a film-foam shrink label held on the drum. The drum is provided with pairs of raised areas which correspond to the leading and trailing edge of an individual label. The drum may have any number of such pairs of raised areas on its peripheral surface consonant with the label length. When the term "raised area" is used, it means that the radius of the drum, which is generally constant, has areas where the radius is slightly greater to, in effect, form pads which are vertically coextensive with the height of the drum but which protrude beyond the general surface of the drum. These pads are provided on the drum to correspond to the leading and trailing edges of the label. Thus susually different size drums are required for different lengths of labels. The raised areas will underlie the leading and trailing edges of the labels and facilitate the application of the solvent to these areas by a rotating gravure roll as taught in the above referred to U.S. Pat. No. 4,574,020. A further example of a vacuum drum is disclosed in copending U.S. patent application Ser. No. 831,682 filed 2-21-86 which details the system for applying vacuum to the vacuum posts in the drum periphery. Also, this copending application discloses the manner of supporting a stationary manifold plate in contact with the bottom of the vacuum drum in order to connect vacuum to the ports and also to apply air pressure and vent the ports in a preselected manner.

SUMMARY OF THE INVENTION

The present invention is an improved vacuum drum for supporting and transporting labels on the surface thereof with the raised pads on the drum periphery being further augmented with raised steps that are the actual underlying areas for the label leading trailing edges that receive the solvent from a gravure roll that engages and transfers the solvent to the label at the leading and trailing edges thereof.

It is an object of the present invention to form the drum surface with an additional step at both the leading and trailing edge supporting pads with the step at the leading edge being a "down" step and the step at the trailing edge being an "up" step.

Other and further objects will be apparent from the following description taken in conjunction with the annexed sheets of drawing.

DETAILED DESCRIPTION OF THE DRAWINGS

Figure 1:
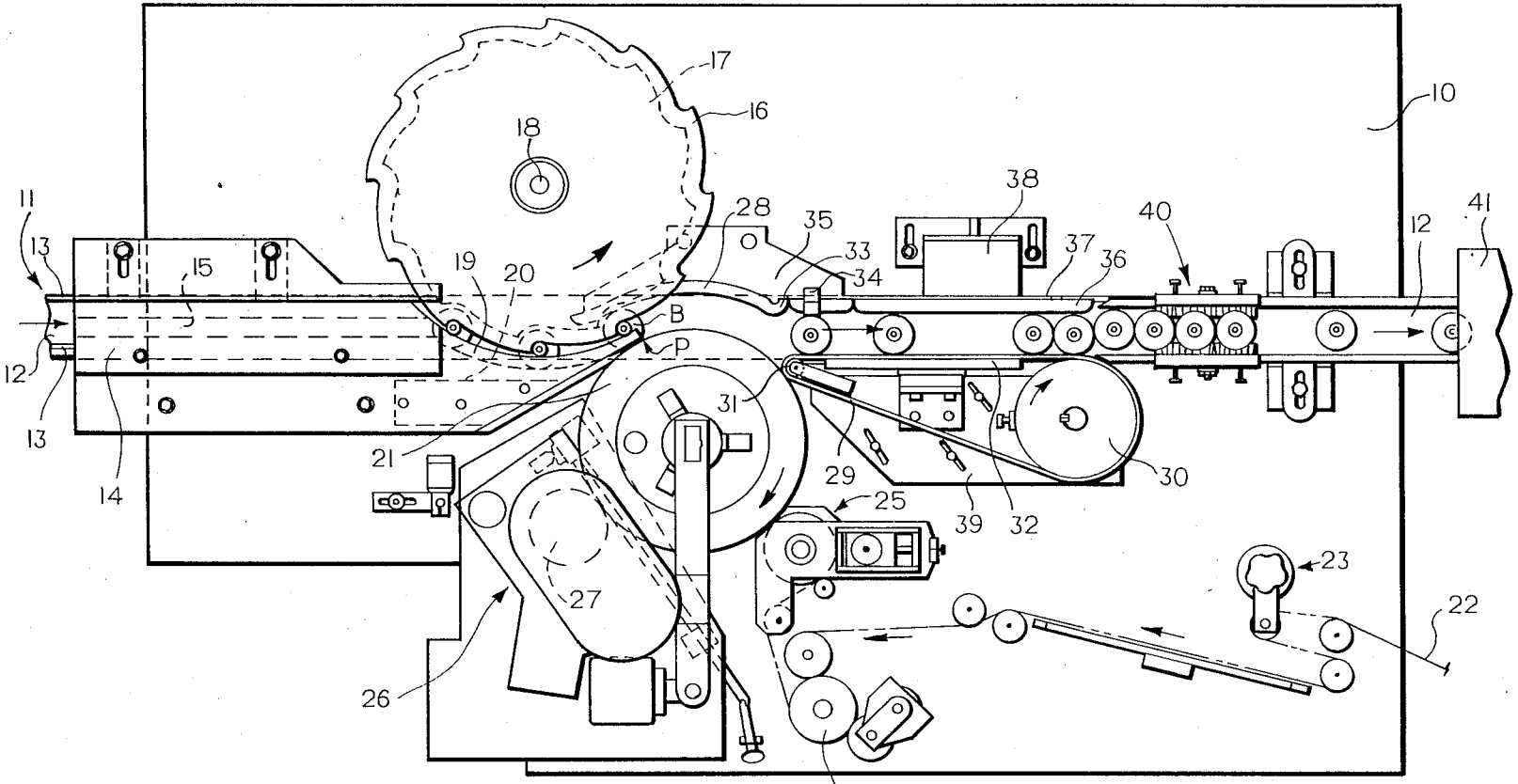
FIG. 1 is a plan view of a bottle labeling apparatus incorporating the vacuum drum of the present invention.
Figure 2:
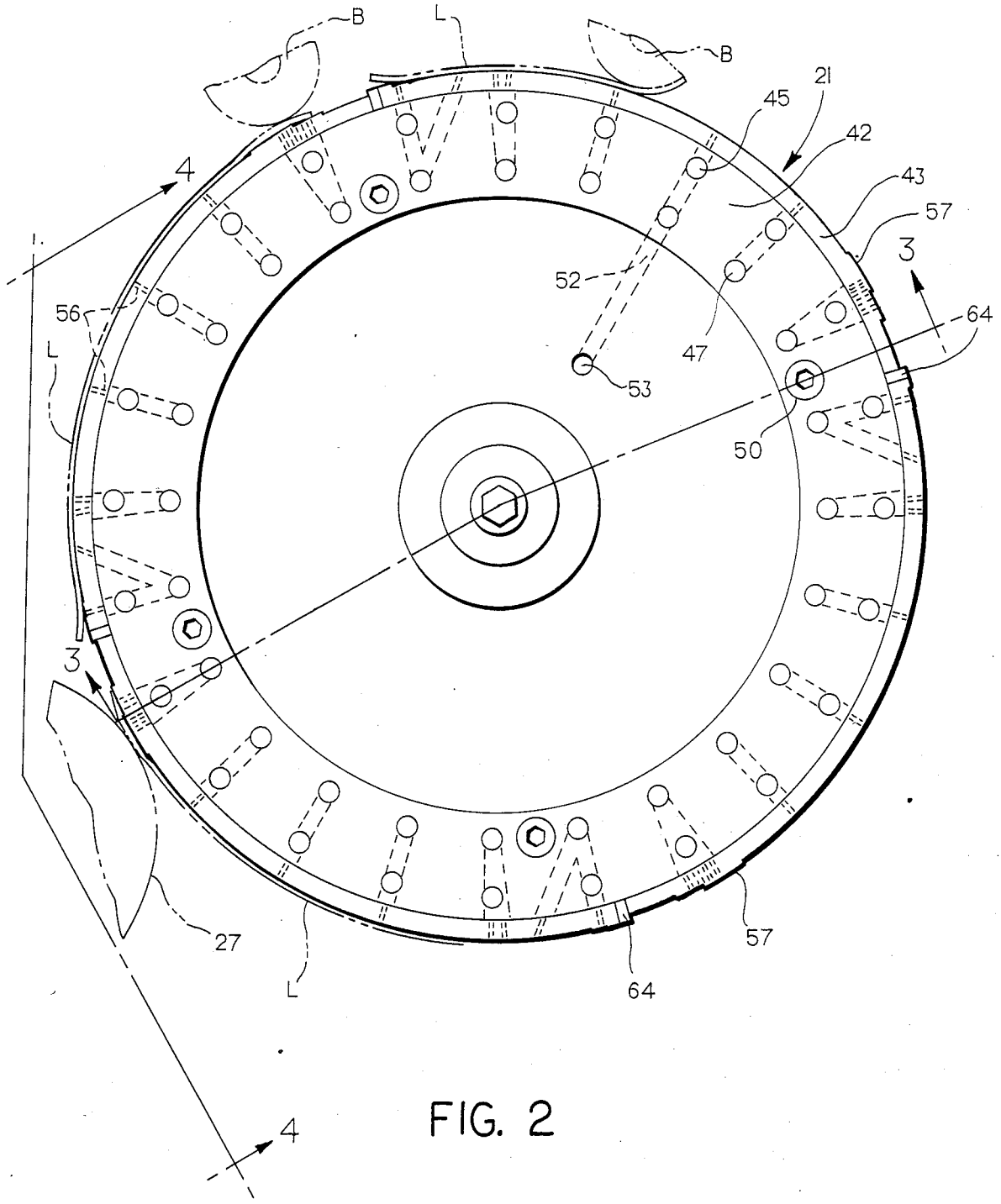
FIG. 2 is an enlarged plan view of the vacuum drum of FIG. 1.

With particular reference to FIG. 1, the following is a general description of the operation of the overall labeling system. A horizontal supporting table 10 of generally rectangular configuration serves to support the mechanisms and is itself supported above the floor by a plurality of vertical legs (not shown). Mounted above the table and extending generally across the length of the table is a conveyor generally designated 11. The conveyor 11 has a horizontally moving upper surface 12 which is driven in the direction of the arrow shown thereon. Containers or bottles B to be labeled are supplied at the left hand end of the conveyor 11 in an upright attitude on the surface 12 of the conveyor. With the conveyor surface 12 moving in the direction of the arrow thereon, the bottles will be carried from the left to the right as viewed in FIG. 1. The bottles are guided by rails 13 which extend along either side of the conveyor 12. An overhead member 14 is shown which is provided in its under surface with a guiding slot 15 within which the finish or neck of the bottles will be guided. As can be seen when viewing FIG. 1, the bottles moving from the left approach a pair of vertically spaced, pocketed starwheels 16 and 17 which are both mounted to a vertical axle 18 which is rotated in a counterclockwise direction as viewed in FIG. 1. The starwheel 16 has 12 pockets circumferentially spaced about the circumference thereof which pockets are adapted to engage the neck of the bottles being handled and the starwheel 17 is provided with a like number of pockets that are of somewhat larger dimension and are adapted to engage the sidewall of the bottles being handled.

An arcuate guide 19 has a contour which is coaxial with respect to the axle 18 and serves to hold the necks of the bottles at a precise distance from the axle 18 of the starwheel 16. In addition, there is a lower arcuate guide 20 which is mounted at a height generally the same as the height of the sidewall or body engaging starwheel 17 to maintain the bottles B with their axes vertical during the movement of the bottles by the starwheels 16 and 17. when a bottle reaches the position generally designated P, the side of the bottle B will approach, generally tangentially, the circumferential periphery of a vacuum drum 21. The vacuum drum 21 is a generally cylindrical member having a height somewhat greater than the height of a label which is to be applied to the bottles B. The drum 21 will have a plurality of vacuum passages opening through the surface thereof to, in effect, grip the individual labels supplied thereto and to convey the labels to the position P. The labels may be formed from a web 22 of foam-film polystyrene which may be pre-printed and which will be coming from a supply (not shown) at the right through a tension takeup device 23. After passing the tension compensating device 23 the web 22 will pass around a driven feed roller 24 and then to a label cutting and handling system generally designated 25. The label cutting device 25 cuts the label at a predetermined point in its length with the leading edge of the label being brought into peripheral engagement with the drum 21. The label will adhere to the outer surface of the drum 21 and move in the direction of the arrow on the drum 21 to carry the label past a glue or solvent applying station 26 where a glue roll or solvent transfer gravure roll 27 will apply the glue or solvent to selected, defined areas of the label. The gravure roll 27 is driven by a mechanism (not shown) generally in a counterclockwise direction, as viewed in FIG. 1, and timed to present the solvent to the leading and trailing edges of the label which is transported by the vacuum drum 21.

At the point P the leading edge of the label will engage the sidewall of the bottle B and the leading edge of the label will become adhered to the bottle. From this point on, the bottle will be held against the surface of the drum by a primary backup pad 28 which is mounted to the surface of the table 10 by a bracket 35. The backup pad 28 may be formed of a resilient foam material such as foam rubber so that it will effectively hold the bottle B against the surface of the drum and, as the drum continues to rotate, the bottle will be effectively rolled along the surface of the label carried on the surface of the vacuum drum 21.

As previously described, the label carried by the drum 21 will have a vertical, full height, line of solvent applied to the trailing edge thereof and the trailing edge of the label will overlap the leading edge and adhere thereto to form an overlap seam. The container with the label applied continues to be guided by the primary backup pad 28 until it reaches a secondary roll-on belt 29. The secondary roll-on belt 29 passes about a drive roll 30 which is driven in the direction of the arrow shown thereon. The belt 29 also passes about a relatively small diameter inlet roll 31. A stationary, vertical backup surface 32 maintains the belt 29 in a fairly straight path between the drive roll 30 and the inlet roll 31. The bottle B will have the label completely wrapped thereabout prior to the movement of the bottle into engagement with the secondary roll-on belt 29. The primary backup pad 28 has an area 33 which tends to maintain the bottle in contact with the vacuum drum 21 until such time as the bottle engages the secondary roll-on belt 29. This provides a positive drive for the bottle so that when the bottle passes to the secondary roll-on belt, it will be rotated while moved along by the moving surface of the belt 29. The moving belt drives the rolling bottle so that the overlap seam of the label will contact a resilient pressing pad 34 which is mounted beyond the primary pad 28 on a bracket 35 which in turn is mounted to the table 10 as previously described.

A secondary backup pad 36 is positioned in bottle engaging, diametrically opposed, position relative to the secondary roll-on belt 29. The pad 36 is also formed with a foam rubber or like resilient member mounted to a plate 37 which in turn is mounted by bracket 38 to the top of the table 10.

It perhaps should be pointed out also that the secondary roll-on belt 29 and its drive roll 30 and inlet roll 31 are both mounted on a mounting plate 39 which may be moved relative to the upper surface of the table 10, and thus be adjusted toward or away from the center line of the conveyor 12 to accommodate the mechanism for different size bottles. Likewise, the secondary backup pad 36 and the bracket 38 which supports it may be moved toward or away from the center line of the conveyor 12.

As can be seen when viewing FIG. 1, the bottles B, after passing between the secondary backup pad and the secondary roll-on belt, will be held back by the brush spacer, generally designated 40, and that the bottles are moved through the brush spacer 40 in surface-to-surface contact under the force created by the moving belt 29, until such time as the leading bottle clears the spacer 40, at which time the bottle is free to move at the speed of the conveyor 12 into a heat shrink oven 41. The bottles will leave the brush spacer at regular intervals depending upon the speed with which the label wrap machine is operating. It should be understood that the drum 21 and drive roll 30 are commonly driven.

Turning now to FIGS. 2–6, the details of the improved vacuum drum 21 of the invention will be described. The drum 21 is formed of a metal, such as "Tenzalloy", an aluminum alloy, cylindrical member 42 with a circumferential covering 43 of fairly hard rubber that is tightly adhered thereto with an interposed adhesive. The cover 43 is basically a continuous resilient structure formed of "Viton" Grade "B" rubber of DuPont Chemical Co. About the circumference of the cylindrical member 42 at regular intervals, there are vertical passages 44 that extend the full height of the drum. The upper and lower ends of the passages 44 are plugged by threaded plugs 45.

Figure 3:
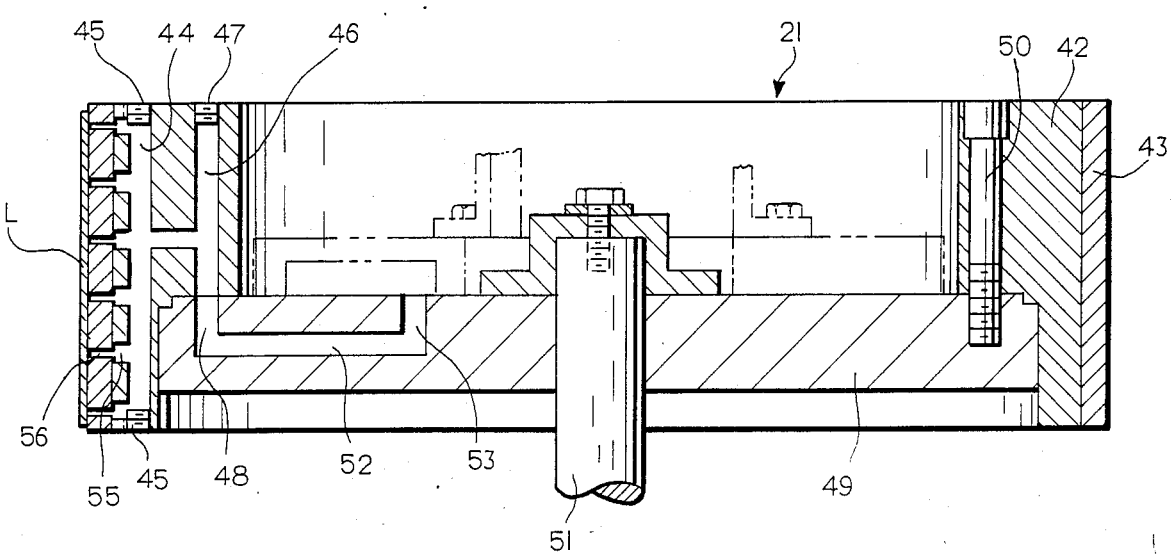
FIG. 3 is a cross-sectional view taken at line 3—3 of FIG. 2.
Figure 5:
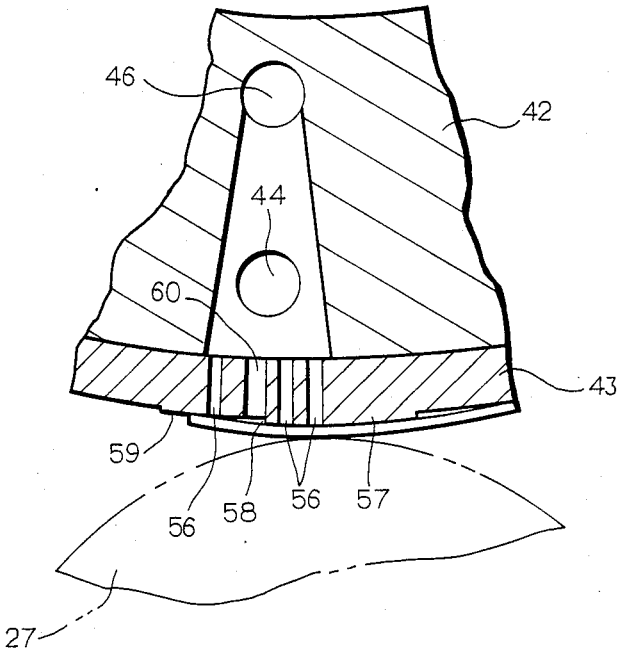
FIG. 5 is an enlarged cross-sectional view taken at line 5—5 of FIG. 4.
Figure 6:
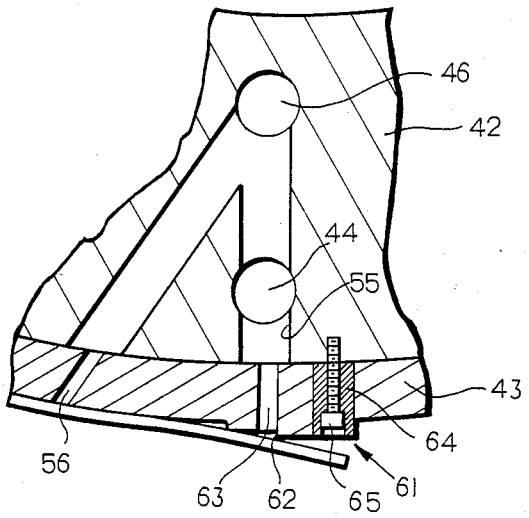
FIG. 6 is an enlarged cross-sectional view taken at line 6—6 of FIG. 4.

As can be seen when viewing FIGS. 3, 5 and 6, the passages 44 are fairly close to the interface of the metal member 42 and cover 43. Radially inwardly of the passages 44 there are parallel, vertical passages 46. The passages 46 have their upper ends closed by threaded plugs 47 while their lower ends open downwardly and communicate with vertical passages 48 in a bottom plate 49 closing the bottom of the member 42. The plate 49 is held to the drum by a plurality of allen head bolts 50 which are threaded into the top of the plate and pass down through countersunk holes in the member 42.

Figure 4:
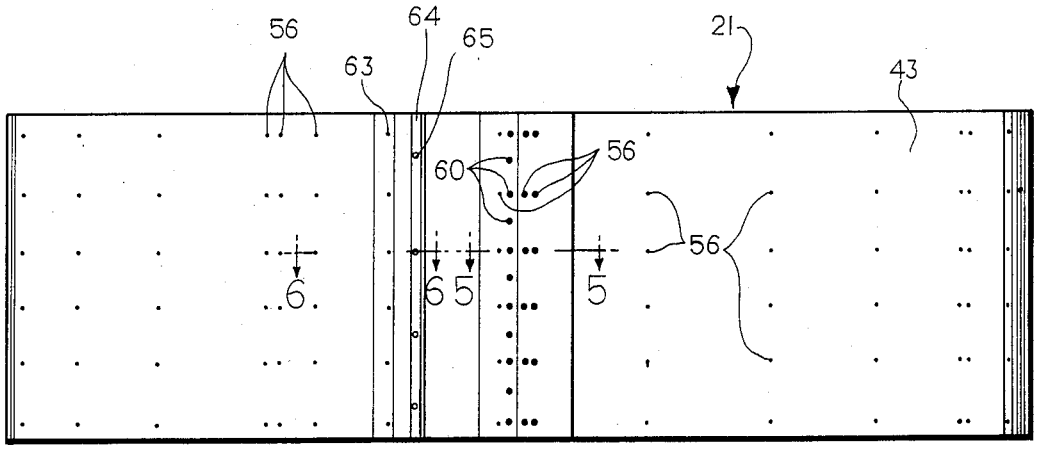
FIG. 4 is a side elevational view of FIG. 2 looking in the direction of arrow 4 on FIG. 2.

The plate 49 and the drum 21 are rotated as a unit by a vertical drive shaft 51 connected to a source of power (not shown). Each of the passages 48 in the plate 49 is connected to a horizontal, radially inwardly, extending passage 52 which in turn has its inner end connected to a vertical passage 53 which opens through the upper surface of the bottom plate 49. The passages 53 communicate with a stationary vacuum manifold plate shown in phantom line in FIG. 3. The plate is the same as that shown in U.S. patent application Ser No. 831,682 filed 2-21-86. It should be understood that vacuum and air pressure may be fed to the passage 53 during the appropriate intervals in the rotation of the drum 21. Each of the passages 46 is connected to a vertical passage 44. Each of the passages 44 is connected to a plurality of radial passages 55 extending out through the periphery of the member 42. Each of the passages 55 communicates with one or more vacuum ports 56 that extend through the cover. While the drum surface, as shown in FIG. 4, has many ports 56 distributed over its surface, there are special sets of ports provided at the areas of the cover which will underlie the leading and trailing edges of the labels. The enlarged section of FIG. 5 shows the specific configuration of the ports 56 and underlying vacuum passages that connect thereto for holding the leading edge of the label. In FIG. 5 there is a "raised" area or pad 57 with a step 58 down to a slightly lower part 59 of the pad 57. The size of the ports 56 that open into the surface 57 are uniform in cross-section with a set of ports 60 that are at the base of the step 58 on the lower level 59 of the pad 57. The labels will be held against and close the ports 56 when the leading edge of the label first engages the drum surface. However, the ports 60 which open at the base of the step 58 will cause the leading edge of the label to be held down against the step. Since the label material most commonly used is a film-foam plastic formed by coextrusion with the film side held in contact with the drum, the label will have some stiffness so that it will not follow the step 58 exactly but will bridge the area at the base of the step. In this manner the vacuum which is applied through the ports 60 will create a vacuum beneath the step that extends substantially the full height of the label and drum. The surface area that becomes vacuumized is many times greater at the step than at any of the individual ports 56 or any collective column of ports. Thus the label is firmly held at its forward or leading edge as shown in FIG. 5 so that when the drum carries the label to the position that the solvent drum 27 engages this leading edge, there will be absolutely no chance for the label edge to be drawn from the drum surface either by static charge attraction or adhesion to the solvent applicating drum as has been a problem in the past. This problem of the label leading edge coming loose from the transport drum 21 has been a limiting factor on the speed with which the labeling system may be operated, and when this occurs, obviously the label will not reach the bottle engaging position "P" but frequently the label would become rolled up on the solvent drum 27 and cause a costly, time-consuming down period for clearing the solvent drum and resuming the startup of the system.

Another point in the operation of the labeling system which has caused problems is the label trailing edge being given a full height line of solvent each and every time the gravure roll comes in contact with the trailing edge. This trailing edge must form a complete overlap seam with the leading edge in order to form a complete label which will pass through a heat shrink tunnel without having the seam open up. In order for this seam to be reliably made on every label, it is important that the solvent line on the trailing edge must be reliably made and one of the most important facets of the formation of this solvent line is the proper setting of the caliper between the label drum 21 and the solvent gravure roll 27. As shown specifically in FIGS. 4 and 6, the trailing edge of the label is held against the drum by a vertical row of vacuum ports 56 just in advance of a raised pad 61 on the cover 43 at the trailing edge of the label. In addition, a small step 62 is formed in the pad 61 and at the base of the step 62 a vertical series of vacuum ports 63 are located. In this manner, the trailing end of the label will be held in a bridging configuration, as illustrated in FIG. 6, over the step 62 and causing the trailing end of the label to actually extend away from the outermost level of the pad 61. In this configuration, the trailing edge portion of the label which is to receive the solvent will actually touch the gravure roll a slight moment before it will become compressed between the gravure roll and the pad 61. This added time helps in assuring the full line application of the solvent and also helps in overcoming, to a certain extent, any caliper adjustment problems that may be present. The caliper at the trailing edge pads are very critical and must be carefully monitored during operation.

As could be expected, the pads 61 will become worn after prolonged use and normally would necessitate replacing the entire drum 21 with one with a new cover 43. In order to cut down on the necessary inventory of extra drums to be used to replace those which may become worn, and the time (approximately 30 minutes) that it takes to replace the entire drum, replacement of the trailing edges of the pads 61 may be provided. The pads 61, which are the "high" spots on the periphery of the drum 21 at the trailing edge of the label and are the most critical areas on the drum, in so far as setting up and running the labeling machine since the trailing edge in all drum pads must be equidistant and any variations, if any, are accumulated at the lead edge. Thus, as shown in FIGS. 4 and 6, insert strips 64 are replaceable when the drum surface becomes worn by removing the socket head cap screws 65. It takes less than five minutes to replace the insert strips and thus the machine down time is considerably less. It may be seen that the areas of the drum which become the most worn are those corresponding to the insert strips 65 and that making these strips replaceable extends the life of a drum.

With the vacuum drum, as described in detail above, the two critical areas of the vacuum drum, namely, the label leading edge and trailing edge, are provided with stepped pads and the location of vacuum ports which create a greater holding force than can be accomplished by merely having ports which open into flat areas of the drum. Further, the steps provide a means to emphasize the holding down force of the leading edge of the label to prevent solvent drum rollup of labels, and a trailing edge step that gives a more certain full height line of solvent applied by a gravure roll to the critical trailing edge of the label. Additionally, replaceable inserts which fit at the trailing edge of the pads on the vacuum drum serve to extend the life of the vacuum drum and save time over having to replace the entire drum when it becomes worn through extended use.

While the foregoing sets forth the best mode contemplated by the Applicant for carrying out the invention, obvious modifications will be apparent from the description and are intended to be encompassed within the scope of the appended claims.

What is claimed is:

1. In apparatus for applying a plastic label circumferentially about a container wherein the containers are moved in a spaced apart, upright attitude into contact with the leading edge of a label carried on the surface of a label transporting drum, with the leading edge and trailing edge of said label having a solvent for the plastic applied thereto to form an adhesive and means are provided for holding the container against the label transporting drum while free to rotate about its axis to wind the label on the container into overlapping sealing relationship, and in which the label transporting drum comprises a hollow cylindrical member having a vertical height at least equal to the height of said label, with a hard, rubberlike cover fixed to the outer surface of said member, said cover having at least one pair of radially, outwardly extending raised areas at spaced apart intervals about the outer circumference thereof, the raised areas of each pair being spaced apart a distance corresponding to the length of the labels to be applied, a plurality of vertical vacuum passages in the cylindrical wall of said drum at spaced intervals thereabout, a plurality of vertically spaced, horizontal passages extending from each of said vertical passages outward through the outer surface of said cover to form vacuum ports, said ports adapted to underlie the labels so that the labels are held to the surface of the cover, at least one vertical row of ports underlying the raised areas corresponding to the leading and trailing edge of a label held on the drum surface, said solvent being applied by contacting the label on the raised areas by a solvent applicating gravure roll mounted for rotation about a vertical axis, the improvement in said label transporting drum cover comprising a slight step formed on the raised area which corresponds to the leading edge of the label, said step constituting a first zone in the direction of drum rotation that is slightly depressed relative to the general level of the leading area, and a vertical row of vacuum ports formed in said cover at the bottom of said step whereby the leading edge of said label will extend over said step and be deflected radially inwardly at its leading edge.

2. The apparatus of claim 1 further comprising a step formed in the raised area corresponding to said trailing edge and vacuum ports at the bottom of said step for deflecting the trailing edge radially outwardly at the step.

3. The apparatus of claim 2 further including a replaceable insert strip extending the full height and thickness of said cover at the trailing edge of the raised areas that underlie the trailing edge of a label being transported by said vacuum drum.

4. In a label handling vacuum drum for receiving and transporting plastic labels held to its surface from a pickup point past an adhesive or solvent applicating roller to a container rotating and label wrap-around section, the improvement in the outer surface of said drum comprising a rubber-like covering surrounding said drum, said cover having at least two raised surface areas for supporting the label adjacent its leading and trailing edges to facilitate the reception of adhesive thereon, each said raised surface area consisting of two levels of surface joined by a vertical step, with the step at each said area being a step up relative to the direction of drum rotation, and a vertical row of vacuum ports extending along the bottom of each step.

5. The improvement of claim 4 further including a replaceable insert strip corresponding to the trailing edge of the raised area on said drum for supporting the trailing edge of the label carried thereby.

* * * * *